US012226005B1

(12) United States Patent
Gardner et al.

(10) Patent No.: US 12,226,005 B1
(45) Date of Patent: Feb. 18, 2025

(54) BACKPACK HAVING A BODY, A HANDLE, AND A TOP FLAP MADE ENTIRELY OF ETHYLENE-VINYL ACETATE FOAM ENABLING A BUTTRESSED OPEN TOP FLAP FUNCTIONALITY

(71) Applicants: Brittany Gardner, Mount Pleasant, SC (US); Erin Jewett, Mount Pleasant, SC (US)

(72) Inventors: Brittany Gardner, Mount Pleasant, SC (US); Erin Jewett, Mount Pleasant, SC (US)

( * ) Notice: Subject to any disclaimer, the term of this patent is extended or adjusted under 35 U.S.C. 154(b) by 0 days.

(21) Appl. No.: 18/806,902

(22) Filed: Aug. 16, 2024

Related U.S. Application Data

(60) Provisional application No. 63/520,134, filed on Aug. 17, 2023.

(51) Int. Cl.
*A45F 3/04* (2006.01)
*A45C 13/34* (2006.01)

(52) U.S. Cl.
CPC ..... *A45F 3/04* (2013.01); *A45C 13/34* (2013.01)

(58) Field of Classification Search
CPC ..... A45F 3/04; A45F 3/047; A45C 13/34
USPC ..... 224/655; 190/902; D3/243, 216, 217
See application file for complete search history.

(56) References Cited

U.S. PATENT DOCUMENTS 5,762,170 A * 6/1998 Shyr ..... A45C 5/14 190/114
D403,853 S * 1/1999 Lothrop ..... D3/216
6,112,959 A * 9/2000 Townsend ..... A45C 11/22 224/640
6,237,825 B1 * 5/2001 Pencoske ..... A45F 3/04 383/117
8,685,465 B2 * 4/2014 Moseley ..... A61K 33/42 514/777
D775,817 S * 1/2017 Ridley ..... D3/217
10,544,976 B2 1/2020 Triska et al.
D896,505 S * 9/2020 Yuan ..... D3/217
11,432,631 B2 * 9/2022 Peng ..... A45C 7/0077
D1,013,368 S * 2/2024 Abel ..... D3/216
D1,025,590 S * 5/2024 Benzon ..... D3/216
2002/0162871 A1 11/2002 Vigny
2003/0024960 A1 * 2/2003 Greenstein ..... A45C 13/02 224/608
2008/0029562 A1 2/2008 Hawkins et al.
2015/0068570 A1 3/2015 Samaripa
2019/0274405 A1 9/2019 Peng

* cited by examiner

*Primary Examiner* — Justin M Larson
(74) *Attorney, Agent, or Firm* — Dunlap Bennett & Ludwig, PLLC

(57) ABSTRACT

A backpack having a body, a handle, and a top flap made entirely of made from ethylene-vinyl acetate. The body having rear surface, a front surface, an upper surface, and a base surface, wherein the upper surface defines an opening by way of an upper periphery. The handle projects upward from the upper periphery. The top flap extends from a rear end to a forward end, wherein the rear end is connected to the rear surface so that the flap is movable between an open condition and a closed condition blocking access to the opening. A flap opening formed in the flap forward of the rear end thereof, wherein the flap opening is dimensioned, shaped, and located along the flap so that in the open condition the handle engages the flap opening so as to prop the flap in a vertically upright position.

10 Claims, 7 Drawing Sheets

BACKPACK HAVING A BODY, A HANDLE, AND A TOP FLAP MADE ENTIRELY OF ETHYLENE-VINYL ACETATE FOAM ENABLING A BUTTRESSED OPEN TOP FLAP FUNCTIONALITY

CROSS-REFERENCE TO RELATED APPLICATION

This application claims the benefit of priority of U.S. provisional application No. 63/520,134, filed Aug. 17, 2023, the contents of which are herein incorporated by reference.

BACKGROUND OF THE INVENTION

The present invention relates to backpacks and, more particularly, a backpack made entirely of ethylene-vinyl acetate (EVA) foam with a buttressed open top flap functionality.

Most backpacks will eventually get wet which will cause mold or mildew to grow within the material; in other words, current backpacks are not made of a waterproof material and easily harbor mold or mildew. Most backpacks are also not made of a virtually indestructible material that will hold its shape regardless of the contents of the backpack, and as a result prior art backpacks become compromised when they develop holes or tears which threaten to unintentionally spill the backpack's contents during use. Such tears and holes happen at the interface of two different types of material or within material that is introduced for reasons not having to do with structural integrity; for instance, within mesh of a mesh pocket which is used only to provide visibility into the mesh pocket, or the use of material that is lightweight, yet not sturdy to withstand the demands of carrying sometimes bulky, pointy, and hard material stuffed aggressively into the backpack. As such, many current backpacks are not lightweight yet sturdy enough to maintain their shape and stand up on their own.

Furthermore, maintaining an upright position is critical to providing quick access to the possibly many pockets of the backpack as well as ensuring the contents of the backpack, which may have been carefully organized during placement therein, do not disadvantageous shift when the backpack slumps or tips over. Having a backpack capable designed to uncompromisingly stand upright while unattended, regardless of the contents stuffed therein, would be a boon to the user worried about the backpack tipping over and disorganizing its contents. Likewise, if a backpack had a top flap that could be propped in an open condition, that too would be beneficial to users interested in visibly inspecting or accessing the backpack's contents.

In sum, current backpacks are not made of a lightweight yet effectively indestructible 100% waterproof material that won't harbor mold or mildew, and so these backpacks cannot be simply hosed down and hung to dry without the risk of mildew or mold growth. Other backpacks are made of cloth or canvas which cannot stand alone for ease of packing or get wet consistently without the risk of mold or mildew growing. Nor do they maintain their upright posture, unassisted, due to their assemblage of different material types.

As can be seen, there is a need for a backpack having a body, flap, and handle made entirely of EVA foam enabling a propped open top flap condition.

SUMMARY OF THE INVENTION

The backpack embodied in the present invention has a body, a handle, and a top flap made exclusively of non-toxic EVA that is 100% waterproof, so it will not harbor mold, mildew, or bacteria, is light weight, maintains form and shape, stands upright on its own, enables a top flap that can be buttressed in an open condition by way of its handle, and is virtually indestructible. The material properties of EVA and that the backpack of the present invention is unitarily made from EVA are critical to providing users with all the above listed advantages; particularly, the upright posture of the backpack body and the top flap that can be braced in an open condition by way of engagement with the handle, because EVA is a is an elastomeric polymer that produces materials which are "rubber-like" in softness and flexibility. The material has good clarity and gloss, low-temperature toughness, stress-crack resistance, hot-melt adhesive waterproof properties. The "rubber-like" softness and flexibility through every portion of a backpack made entirely of EVA critically enables the backpack to stand in an upright posture even when internally loaded with a plurality of differently shaped, possibly bulky, items. This "rubber-like" softness and flexibility critically enables the buttressed top flap functionality, disclosure in more detail below, while simultaneously providing the other previously listed advantages. This is critical, because as mentioned above many tears or holes or other structural instabilities form at the junction, joint or interface of two different types of materials.

In one aspect of the present invention, a backpack having a body having rear surface, a front surface, an upper surface, and a base surface, wherein the upper surface defines an opening by way of an upper periphery; a handle projects upward from the upper periphery; and a flap extends from a rear end to a forward end, wherein the rear end is connected to the rear surface so that the flap is movable between an open condition and a closed condition blocking access to the opening, wherein the body, the flap, and the handle are entirely made of ethylene-vinyl acetate.

In another aspect of the present invention, the backpack further provices a flap opening formed in the flap forward of the rear end thereof, wherein the flap opening is dimensioned, shaped, and located along the flap so that in the open condition the handle engages the flap opening so as to prop the flap in a vertically upright position; a plurality of holes formed into the rear and front surfaces, wherein each hole of the plurality of holes is sized for water to flow therethrough, wherein the base surface has a transverse cross section greater than any other part of the body, wherein the base surface comprises a sheath which seats a bottommost portion of the body; two adjustable straps, wherein each adjustable strap interconnects two points along the rear surface, wherein the two adjustable straps are made from ethylene-vinyl acetate; and an indented indicia area along the front surface.

These and other features, aspects and advantages of the present invention will become better understood with reference to the following drawings, description and claims.

DETAILED DESCRIPTION OF THE INVENTION

Figure 1:
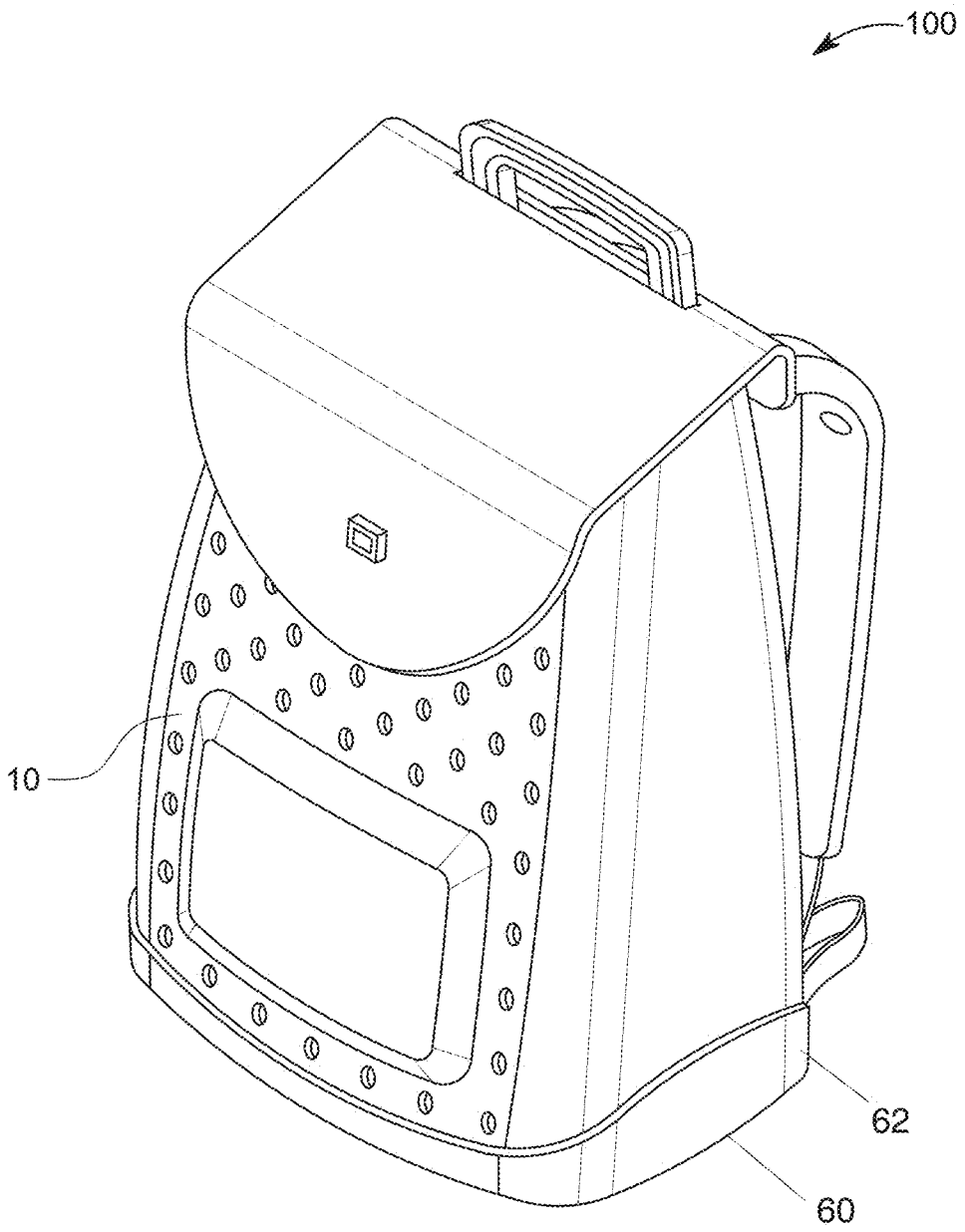
FIG. 1 is a top perspective view of an exemplary embodiment of the present invention.
Figure 2:
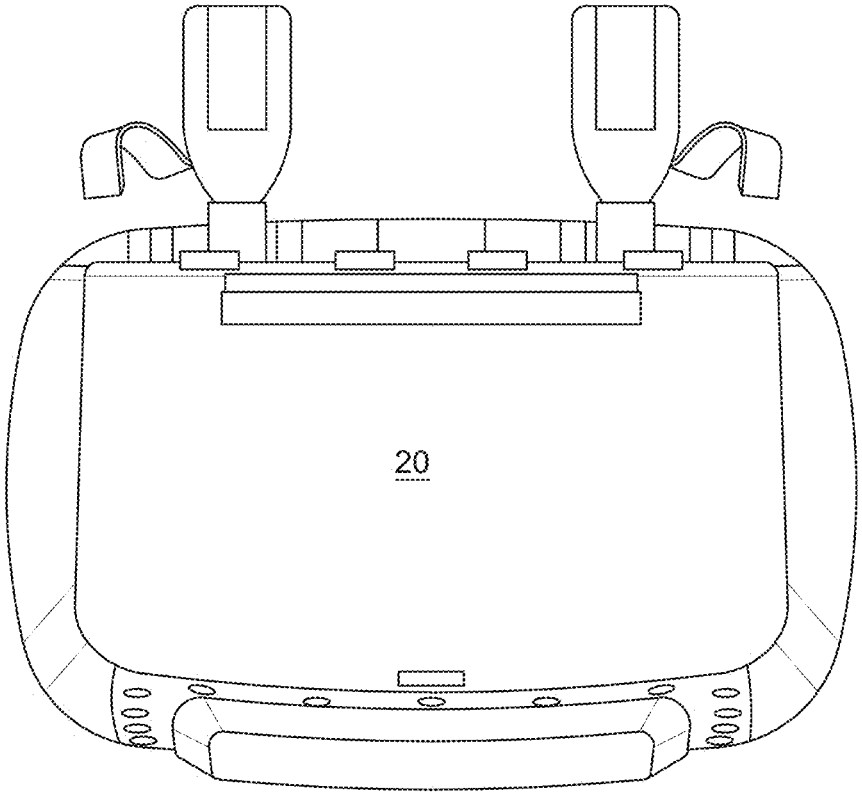
FIG. 2 is a bottom plan view of an exemplary embodiment of the present invention.
Figure 3:
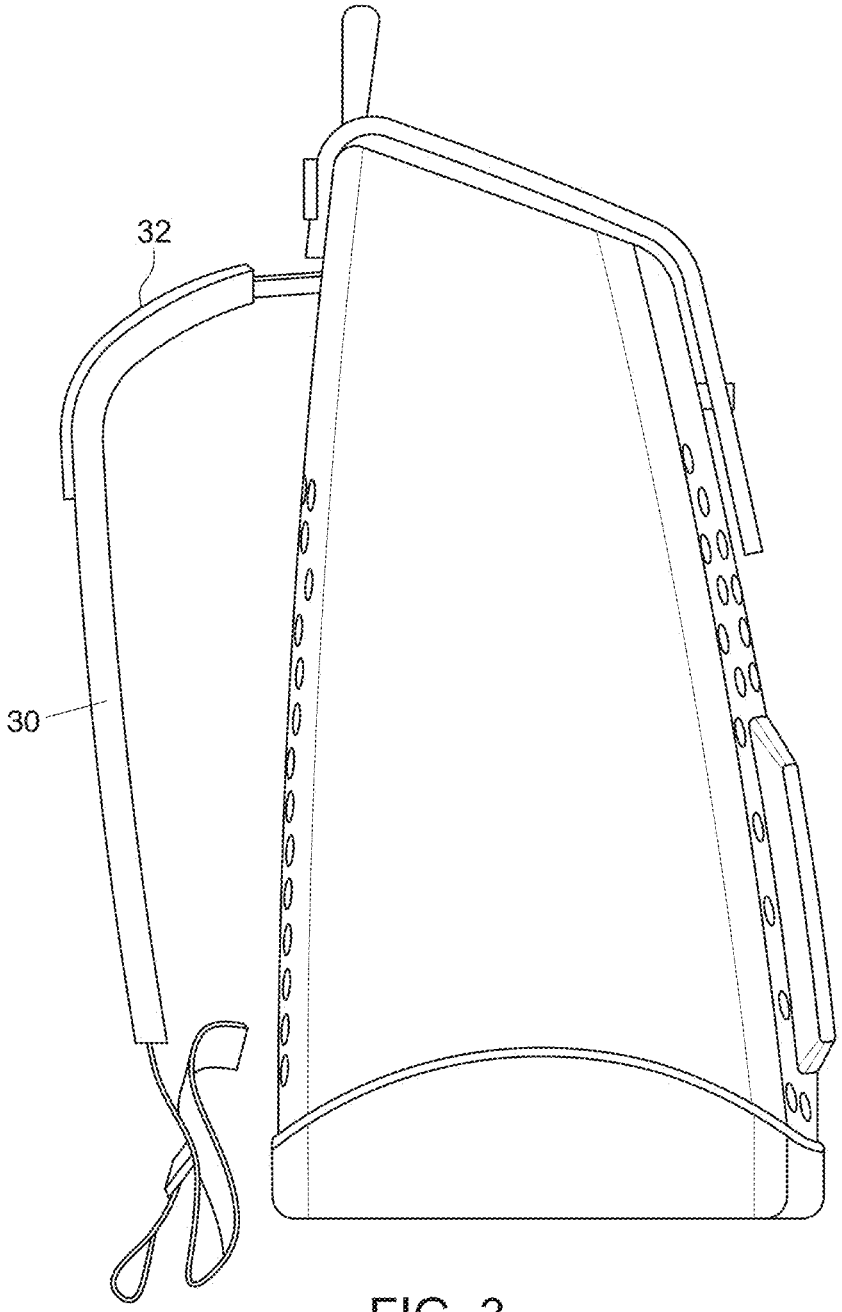
FIG. 3 is a left-side elevation view of an exemplary embodiment of the present invention.
Figure 4:
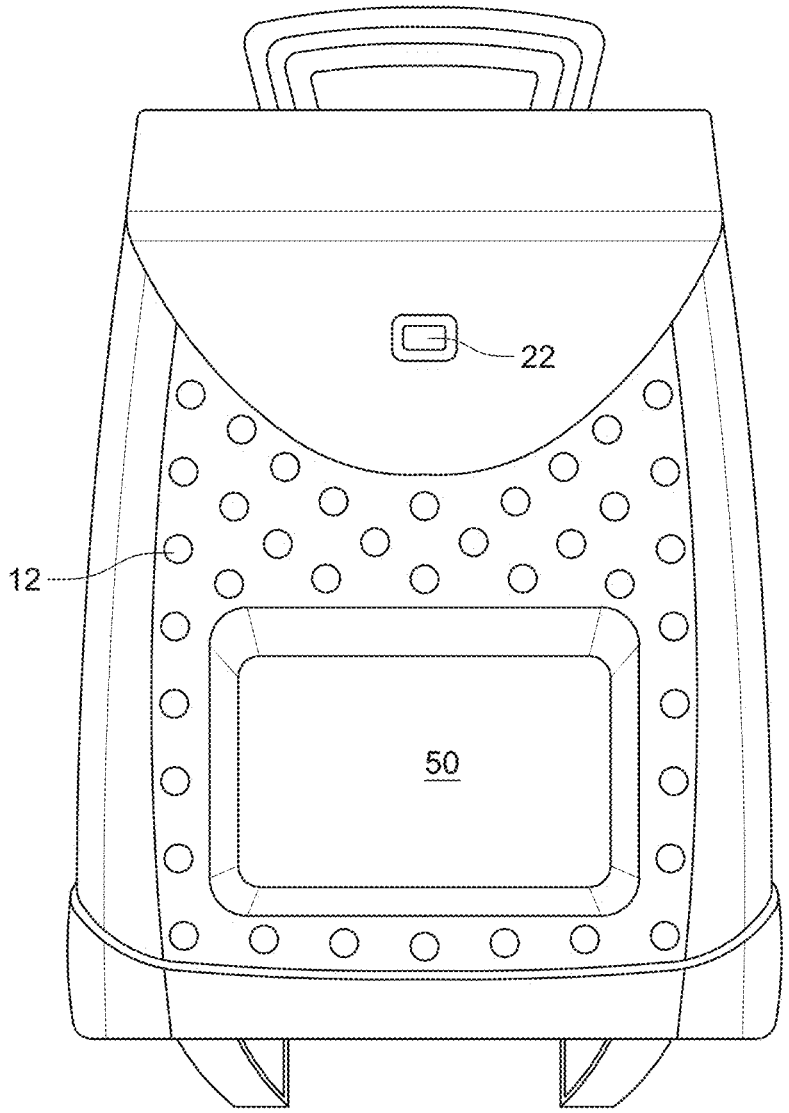
FIG. 4 is a front elevation view of an exemplary embodiment of the present invention.
Figure 5:
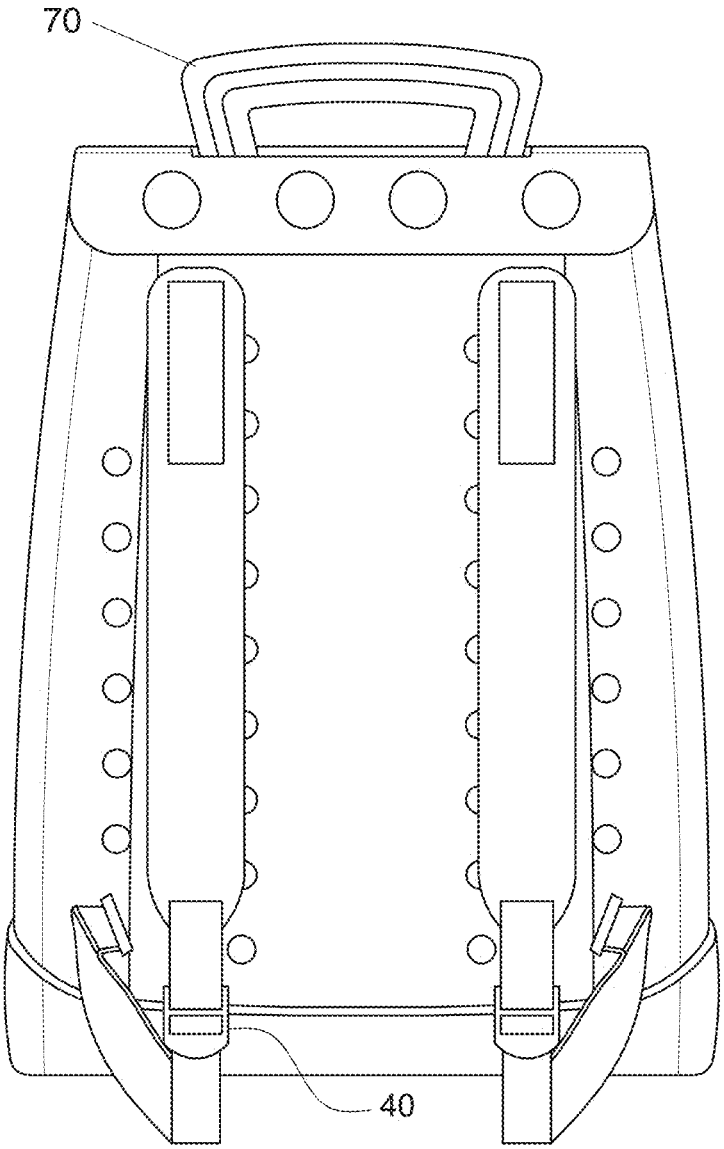
FIG. 5 is a rear elevation view of an exemplary embodiment of the present invention.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Referring now to FIGS. 1 through 7, the present invention may include a backpack 100 with an ethylene-vinyl acetate (EVA) backpack body 10 containing hole pattern 12, an EVA top flap 20 with a twist clasp or another type of securing mechanism 22, foam straps 30, an EVA handle 70, a waterproof nylon webbing 32 running through straps 30, a tri-glide adjustable buckle 40, male/female rivets, an interior pouch, and male/female snaps.

The backpack body 10 and handle 70 are made entirely from EVA, which may be injected into a mold/tool to form the body 10 of the backpack 100. Included in the tooling may be a pattern of holes 12 for airflow ventilation. The top flap 20 is EVA as well, it too may be made from the same or different injection mold. EVA may also be injection molded to form the straps 30 of the bag 100. Waterproof nylon 32 may be threaded through the straps 30 and attached to the bag via male and female rivets to reinforce the straps 30. Plastic tri-glide adjustable buckles 40 may be added to the nylon for adjustment purposes. Twist clasp or another type of securing mechanism 22 may be bonded to the top flap 20 to use as a locking/securing device. Plastic rivets may be used to attach the top flap to the body of the bag. The plastic slider buckles 40 may be fixed to the top portion of the bag 100 and inserted into the bottom of the bag so that the straps 30 are removable from the bottom only. The removeable interior pouch may be attached to the bag via male and female snaps or the like.

Backpack 100 is injection molded with an EVA material that is durable, lightweight, waterproof, won't harbor mold or mildew, and can be sanitized. The body of the bag has a pattern of holes 12, so that backpack 100 can be easily cleaned with water or cleaning products. The holes 12 allow for air circulation to aid in a rapid drying process. The present invention, being in the form of a backpack, allows for better ergonomic use.

The base 60 of the backpack 100 may have the largest cross section (taken along the axial or horizontal or transverse plane), thereby facilitating the tendancy for the backpack 100 to maintain its upright posture, resisting any urge to topple over due to assymetrical internal loading caused by a plurality of differently shaped contained items. The base 60 may include a sheath 62 dimensioned and shaped to seat the bottom of the body 10.

Figure 6:
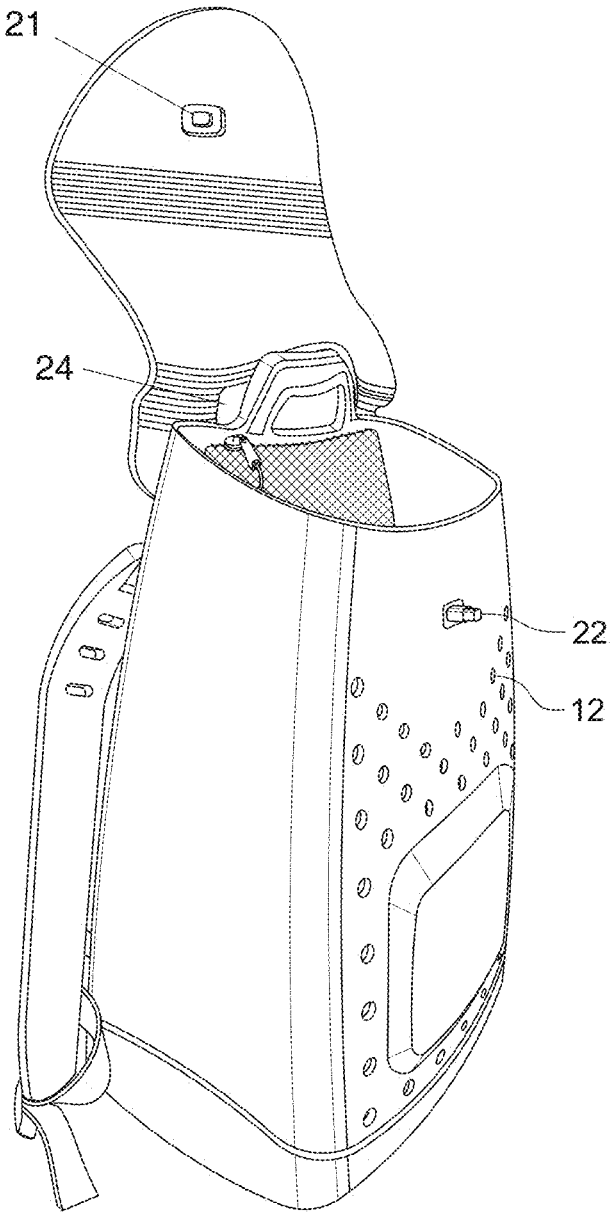
FIG. 6 is a top perspective view of an exemplary embodiment of the present invention, illustrating in a buttressed upright top flap in an open condition.
Figure 7:
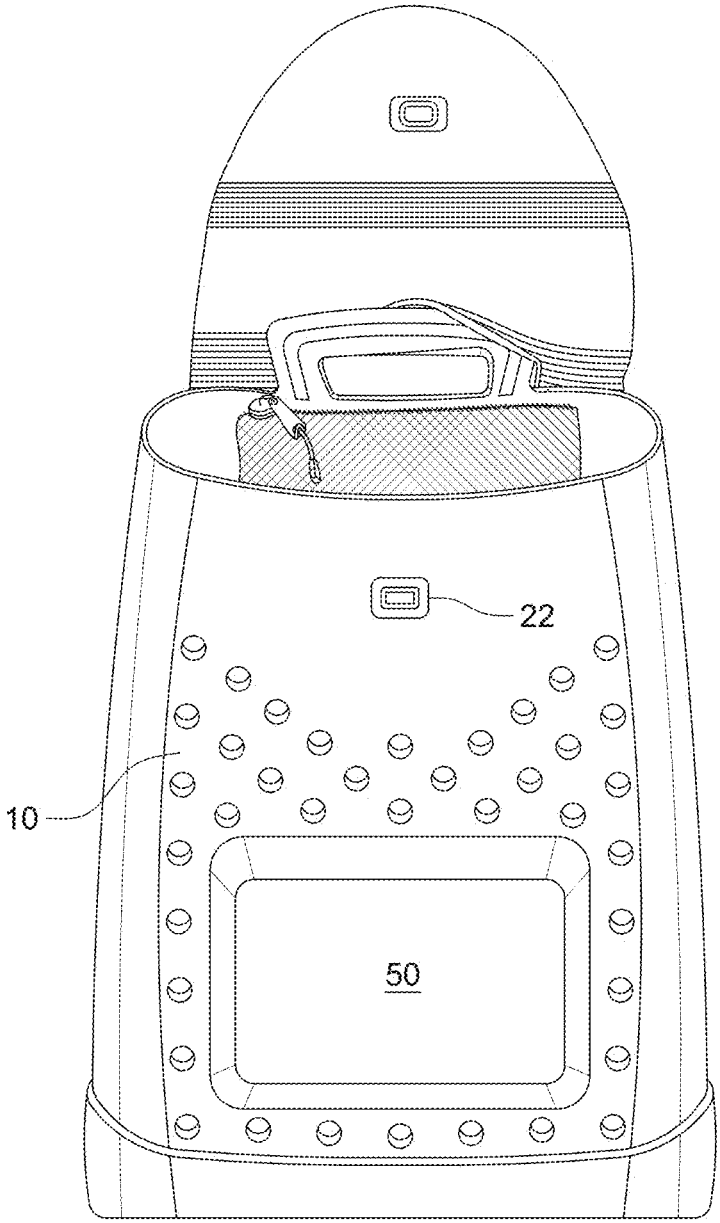
FIG. 7 is a front elevation view of an exemplary embodiment of the present invention, illustrating in the buttressed upright top flap in the open condition.

The top flap 20 may be generally bean-shaped as it extends along a longitudinal axis from a rear end to a front end. The rear end is fixed to a rear exterior surface of the body 10, which enables the top flap 20 to move between an open condition and a closed condition. The front end of the top flap extends to overlap a portion of the front surface of the body 10 so as to engage the securing mechanism 22 (with its complementary mechanism 21, inward of the front edge of the front end). Forward of the rear edge of the rear end, the top flap 20 has a rectangular opening 24. The opening 24 is dimensions and adapted to slidably receive the handle 70 when in the fully or partially closed positions. In the open condition, the upper surface of the handle 70 can be wedged in the opening 24, as illustrated in FIGS. 6 and 7, wherein the handle 70 buttresses the top flap 20 when in the open condition to be in a generally vertical upright position. This is referred to as the 'buttressed open top flap' functionality or configuration. The properties of EVA is critical to enabling the interlocking engagement between the handle 70 and the flap opening 24 sufficient to form the buttressed open top flap functionality or configuration.

Along a front surface of the body 20 may be an indented indicia area 50 wherey trademarks, brand names, logos, messages, art, or the like may be placed to be visible in either the open condition or the closed condition.

A method of making the present invention may include the following. CAD files are designed so that a tool can be made for the injection molding process. Once CAD files are completed the tools for the mold are then made. After the tools are completed, EVA is injected into the tool/mold to form the body of the bag, straps, and top flap. Once the EVA bag pieces are produced, they are then assembled. The top flap will be attached via male and female rivets. Waterproof nylon may be threaded through a channel in the EVA foam strap. A tri-glide adjustable buckle will then be attached to the nylon to allow for strap length adjustment. The top portion of the straps will then be fixed to the body of the backpack via a slider buckle. This portion will not be removeable. The lower connection of the straps will be removable to allow for manipulation in case the straps get twisted. A removable pouch will then be attached to the interior top portion of the back of the backpack via male and female snaps. This allows for the pouch to be removable.

The EVA foam is necessary to meet the goals of durability, lightweight, mold and mildew resistant, nontoxic, while also having a self-sustaining upright posture and enabling the buttressed top flap in an open, upright position. The bottom of the bag is thicker so that it stands up on its own. The holes 12 are necessary to aid in drying as the backpack is meant to be hosed down when soiled. The nylon in the straps reinforces the integrity of the straps as well as allows for adjustment. The top flap and locking mechanism are important to contain contents. The interior pouch is optional but useful.

The hole pattern could be altered. Different types of strap fasteners and connections could be utilized. A different locking mechanism for the flap could be utilized. The straps could potentially be reconfigured.

A method of using the present invention may include the following. A parent is taking their children to the beach and needs a large bag to contain all the beach necessities. Backpack 100 is large enough to hold several contents, lightweight enough not to be cumbersome and is carried on the back to free up both arms for other purposes. Once the day is completed, our EVA backpack can be rinsed down with water to remove sand, crumbs, etc. Then the bag can be placed upside down to dry or simply hung up by the handle to dry. The fact that this EVA material is waterproof and prevents harbor mold or mildew solves the problem that other backpacks encounter. In contrast, if a cloth or nonwaterproofed bag gets damp from water, juice, or any other liquid then mold will start growing. This does not happen with the present invention when it encounters liquids. Also, the present invention is also nontoxic, so it is safe to carry on bare skin.

Another example of how the bag 100 could be utilized is in the medical field. Medical personnel could carry our bag into patients' rooms, operating rooms, etc. and then wipe it down with a sanitizing wipe to remove any bacteria or germs that were encountered. It can be wiped down repeatedly with sanitizer without the risk of mold/mildew growing.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A backpack comprising:

a body having rear surface, a front surface, an upper surface, and a base surface, wherein the upper surface defines an opening by way of an upper periphery;

a handle projects upward from the upper periphery; and a flap extends from a rear end to a forward end, wherein the rear end is connected to the rear surface so that the flap is movable between an open condition and a closed condition blocking access to the opening, wherein the body, the flap, and the handle are entirely made of ethylene-vinyl acetate.

2. The backpack of claim 1, further comprising a flap opening formed in the flap forward of the rear end thereof, wherein the flap opening is dimensioned, shaped, and located along the flap so that in the open condition the handle engages the flap opening so as to prop the flap in a vertically upright position.

3. The backpack of claim 1, further comprising a plurality of holes formed into the rear and front surfaces, wherein each hole of the plurality of holes is sized for water to flow therethrough.

4. The backpack of claim 1, wherein the base surface has a transverse cross section greater than any other part of the body.

5. The backpack of claim 1, wherein the base surface comprises a sheath which seats a bottommost portion of the body.

6. The backpack of claim 1, further comprising two adjustable straps, wherein each adjustable strap interconnects two points along the rear surface.

7. The backpack of claim 6, wherein the two adjustable straps are made from ethylene-vinyl acetate.

8. The backpack of claim 1, further comprising an indented indicia area along the front surface.

9. A backpack comprising:

a body having rear surface, a front surface, an upper surface, and a base surface, wherein the upper surface defines an opening by way of an upper periphery;

a handle projects upward from the upper periphery;

a flap extends from a rear end to a forward end, wherein the rear end is connected to the rear surface so that the flap is movable between an open condition and a closed condition blocking access to the opening, wherein the body, the flap, and the handle are entirely made of ethylene-vinyl acetate;

a flap opening formed in the flap forward of the rear end thereof, wherein the flap opening is dimensioned, shaped, and located along the flap so that in the open condition the handle engages the flap opening so as to prop the flap in a vertically upright position;

a plurality of holes formed into the rear and front surfaces, wherein each hole of the plurality of holes is sized for water to flow therethrough, wherein the base surface has a transverse cross section greater than any other part of the body, wherein the base surface comprises a sheath which seats a bottommost portion of the body;

two adjustable straps, wherein each adjustable strap interconnects two points along the rear surface, wherein the two adjustable straps are made from ethylene-vinyl acetate; and an indented indicia area along the front surface.

10. A backpack comprising:

a body having rear surface, a front surface, an upper surface, and a base surface, wherein the upper surface defines an opening by way of an upper periphery;

a handle projects upward from the upper periphery; and a flap extends from a rear end to a forward end, wherein the rear end is connected to the rear surface so that the flap is movable between an open condition and a closed condition blocking access to the opening; and a flap opening formed in the flap forward of the rear end thereof, wherein the flap opening is dimensioned, shaped, and located along the flap so that in the open condition the handle engages the flap opening so as to prop the flap in a vertically upright position.

* * * * *